US006699111B2

(12) United States Patent
Legner et al.

(10) Patent No.: US 6,699,111 B2
(45) Date of Patent: Mar. 2, 2004

(54) HAND-GUIDED GRINDING OR SANDING DEVICE

(75) Inventors: Roland Legner, Leutenbach (DE); Heinz-Joachim Schneider, Buchs (CH); Silvio Vogt, Nendeln (LI)

(73) Assignee: Hilti Aktiengesellschaft, Schann (LI)

( * ) Notice: Subject to any disclaimer, the term of this patent is extended or adjusted under 35 U.S.C. 154(b) by 0 days.

(21) Appl. No.: 09/735,348

(22) Filed: Dec. 12, 2000

(65) Prior Publication Data

US 2001/0004580 A1 Jun. 21, 2001

(30) Foreign Application Priority Data

Dec. 16, 1999 (DE) ..... 299 22 108 U

(51) Int. Cl.[7] ..... B24B 23/00

(52) U.S. Cl. ..... 451/344; 451/354; 451/355; 451/356; 30/371

(58) Field of Search ..... 451/344, 354, 451/355, 356, 357, 358; 30/371, 380, 388

(56) References Cited

U.S. PATENT DOCUMENTS

D431,437 S * 10/2000 Niwa et al. ..... D8/62

* cited by examiner

*Primary Examiner*—Joseph J. Hail, III
*Assistant Examiner*—Alvin J. Grant
(74) *Attorney, Agent, or Firm*—Sidley Austin Brown & Wood, LLP

(57) ABSTRACT

A hand-guided grinding device (1) carries out a planar grinding motion and is mounted on a motor-driven grinding disk (2). The grinding disk (2) is mounted on a shaft, extending outwardly from a central housing (4) of the device, located axially above the grinding disk (2) and serving to accommodate a transmission unit and a motor. The grinding device (1) has a main handle (6) and an additional handle (8) for the two-handed operation of the device (1), and the handles (6, 8) project essentially laterally from the central housing (4) of the device at two mutually opposite sides of the central housing (4) of the device. The central housing (4) of the device has a housing section (9), which axially adjoins the grinding disk (2), and projects laterally outwardly from the central housing (4) of the device at least in certain regions and is equipped with a gripping surface (10) for one-handed operation.

9 Claims, 2 Drawing Sheets

HAND-GUIDED GRINDING OR SANDING DEVICE

FIELD OF THE INVENTION

The invention is directed to a hand-guided grinding or sanding device for carrying out a planar grinding motion and the device is mounted on a grinding disk. The device has a central housing positioned above the grinding disk which is mounted on an axis of a shaft extending downwardly from the central housing. The central housing has a main handle and an additional handle for two-handed operation of the device.

BACKGROUND OF THE INVENTION

For working planar, concave or convex surfaces of parts of wood, plastic, plaster and also metal, grinding devices of different constructions are used. The types of grinding devices, most in use, are either orbital sanders or eccentric sanders, for which the part is worked by a grinding or sanding element carrying out a motor-driven, flat grinding motion, in order to eliminate dimensional inaccuracies and, depending on the grinding or sanding element used, achieve a more or less smooth surface.

The housings of known grinding equipment extend essentially above the grinding surface and accommodate the driving motor and a transmission. The devices mostly also have a laterally protruding housing part, in which further electronic components are accommodated. A dust collection bag or similar devices are also fastened to the laterally projecting part of the housing. While being operated, the known grinding devices usually are guided with two hands. For this purpose, the laterally projecting part of the housing is constructed as a handle. A second handle is disposed at the side of the central housing, spaced from the laterally projecting part of the housing that is constructed as a handle. Due to the two-handed operation, a larger pressure can be exerted on the grinding surface, disposed between the two handles, and the planar contact between the equipment and the part can be controlled quite well.

For the fine finishing of surfaces, for which such a high contacting pressure is not required, the grinding device usually is guided by only one hand. For this purpose, the user takes hold of the grinding device in the head region of the central housing, which has a contacting surface for the hand. During the single-handed guidance of the known grinding devices, the guiding hand is at a relatively large distance from the surface being ground. As a result, the user loses touch for the grinding progress of the surface. Because of the disadvantageous relationship between the dimensions of the grinding surface of the grinding device and the height of the position of the handle over the grinding surface, an overturning moment is very large. Accordingly, there is the danger that, because of a tilting of the grinding device, corrugations and grinding tracks are produced in the surface of the part with the result that the grinding will be unsatisfactory. In the case of grinding at vertical walls, in which the device is held with a perpendicular alignment of its grinding surface, and while grinding curvatures of a part, the expenditure of a greater force is required because of the distance of the center of gravity of the device from the position of the handle.

SUMMARY OF THE INVENTION

Therefore it is a primary object of the invention to provide a remedy for these disadvantages in the state of the art. A hand-guided grinding device is provided which can be guided by one hand with little expenditure of force. The danger of grinding tracks, resulting from a tilting of the grinding device, is decreased. At the same time, the device is ready for diversified use for a one-handed or a two-handed operation, for which the user can select the way of holding the grinding device, which is most advantageous for him and the respective application purpose.

This objective is accomplished by a housing section on the central housing axially adjoining the grinding disc projecting laterally from at least in part and has a gripping surface for one-handed operation. Further advantageous developments of the invention and/or preferred examples are the object of the dependent claims. Accordingly, the object of the invention is a hand-guided grinding device for a grinding element, which carries out a planar grinding motion and is mounted on a grinding disk, which can be driven by a motor. The grinding disk is mounted on a shaft, which protrudes from a central housing of a device that extends axially above the grinding disk and serves to accommodate a transmission unit and a motor. The grinding device has a main handle and an additional handle for the two-handed operation of the device. The handles project from opposite sides of the central housing of the equipment, essentially laterally from the latter. The central housing of the device has a housing section, which adjoins the grinding disk axially and projects laterally over the central housing of the device at least in part and is equipped with a gripping surface for a single-handed operation.

Since the central housing of the device has a housing section, equipped with a gripping surface and adjoins the grinding disk, a more sensitive one-handed guidance is made possible. The position of the handle is clearly closer to the grinding surface. Due to the lower handle position, a tilting moment is reduced. This decreases the danger of an unsatisfactory grinding resulting from tilting of the grinding equipment. The lower position of the handle leads to a lesser expenditure of force, even when the grinder is guided with one hand on surfaces that are not horizontal, and ensures fatigue-free working.

To improve the counter-balancing of the grinding device, it proves to be advantageous if the axial projections of the gripping surface and the planar grinding surface, formed by the grinding disk, essentially overlap one another. Advisably, the projection of an essential part of the gripping surface lies within the grinding surface, so that the housing section with the additional gripping surface does not present an obstacle when working in regions close to the edge of the grinding surface.

From a construction point of view and in regard to the space required for the transmission unit and a normally provided fan wheel for aspirating the grinding dust, an average distance between the gripping surface and the grinding surface of the grinding disk of about 100 mm to about 140 mm proves to be advantageous. At this distance, there is sufficient space in the housing section for the units that have to be accommodated. Nevertheless, the low handle position is retained and, with that, sensitive guiding by one hand is made possible, in order to achieve better precision grinding qualities. The gripping surface extends essentially parallel to the grinding surface and slopes downward slightly in the direction of the main handle. Due to this ergonomically optimized construction of the gripping surface, the ball of the thumb of the user rests on the slightly declining part of the gripping surface. By these means, fatigue-free work is possible.

For counter-balancing the grinding device, it proves to be advantageous if the central part of the housing is disposed offset in the direction of the additional handle relative to a central axis, which passes through the center of the grinding disk along a straight line connecting the main handle and the additional handle. In this connection, at least ⅗ of the gripping surface extends from the central housing of the device essentially in the direction of the main handle. By shifting the central housing of the device from the center of the grinding surface of the grinding disk parallel to the axis, the gripping surface can be positioned even better over the center of gravity of the device, which advantageously coincides with the center of the grinding plate. By these means, the symmetry of the compressive force, exerted on the grinding surface during the processing of the surface of a part, can be controlled even better by the user.

Sections of the gripping surface advantageously extend over about 240° to about 300° of the periphery of the central housing of the device, so that the hand of the user can embrace the central housing of the device even better and the guidance of the grinding device is improved.

For reasons of space, it proves to be advantageous if the gripping surface borders on the additional handle. Since the outer contours of the gripping surface and the additional handle advantageously go over into one another continuously, protruding edges, which could be an obstacle to operating the device, are avoided.

For a particularly comfortable two-handed operation, the additional handle can be pulled out in a lateral direction. One or more locking positions permit the additional handle to be locked in positions, into which it has been pulled out to a different extent. In this way, the user can select the arrangement of handle positions, which is most advantageous and comfortable for him.

In order to make it possible to work near the edge, the additional handle, in the pushed-in state, does not project over the grinding surface.

For stability reasons, it proves to be advantageous if the housing section, equipped with the gripping surface, adjoins one arm of the hoop-shaped main handle. Preferably, the two parts are connected together, for example, by bolts.

To suppress vibrations occurring under operating conditions, the housing section, having the gripping surface, is provided with a vibration-inhibiting coating or manufactured altogether from a vibration-inhibiting material.

In the following, the invention is described in greater detail with reference to an embodiment, which is shown in various views in the drawings, partly in diagrammatic representation

DESCRIPTION OF THE EMBODIMENT

Figure 1:
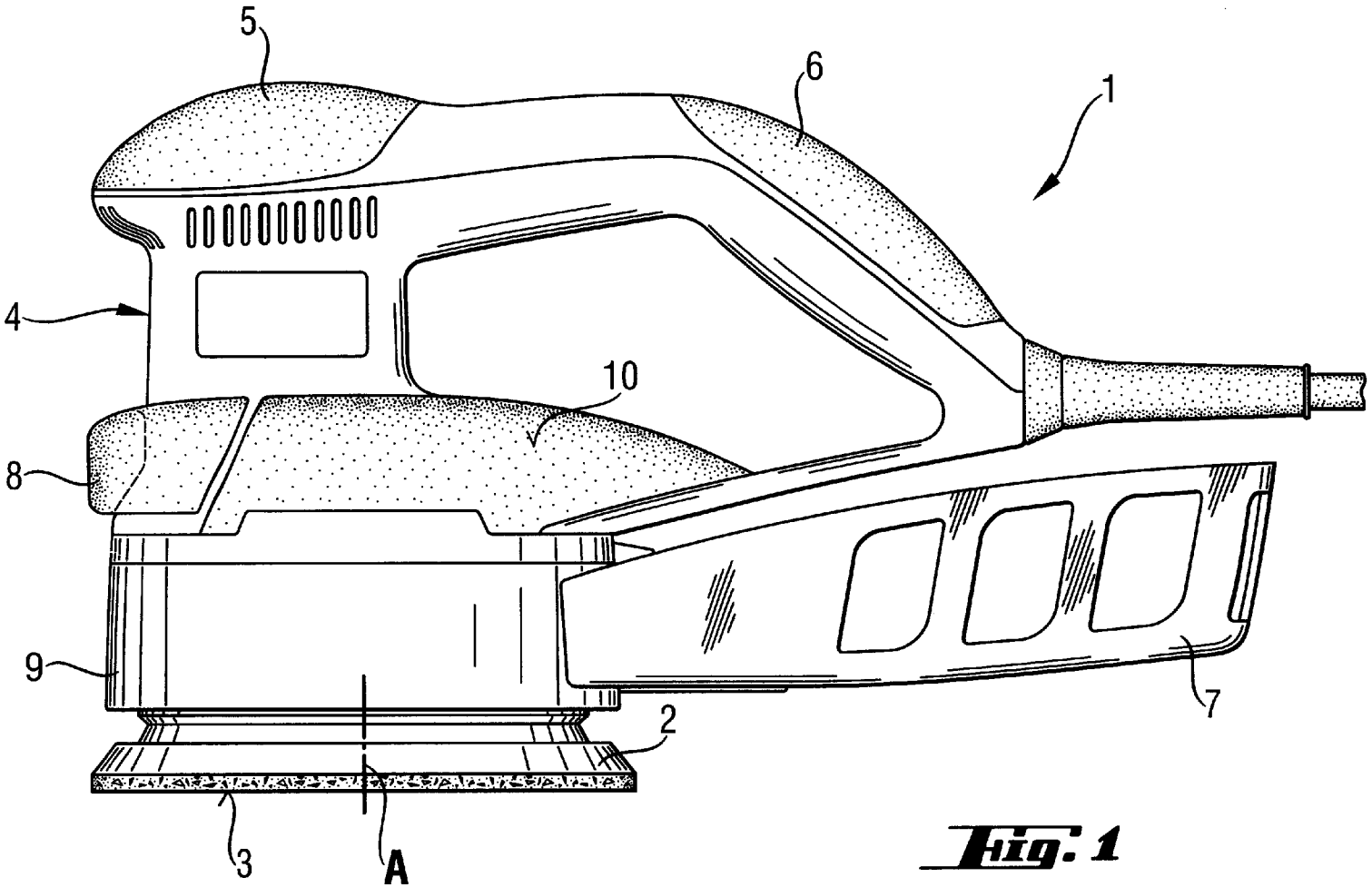
FIG. 1 is a side view of a hand-guided grinding device embodying the invention.
Figure 2:
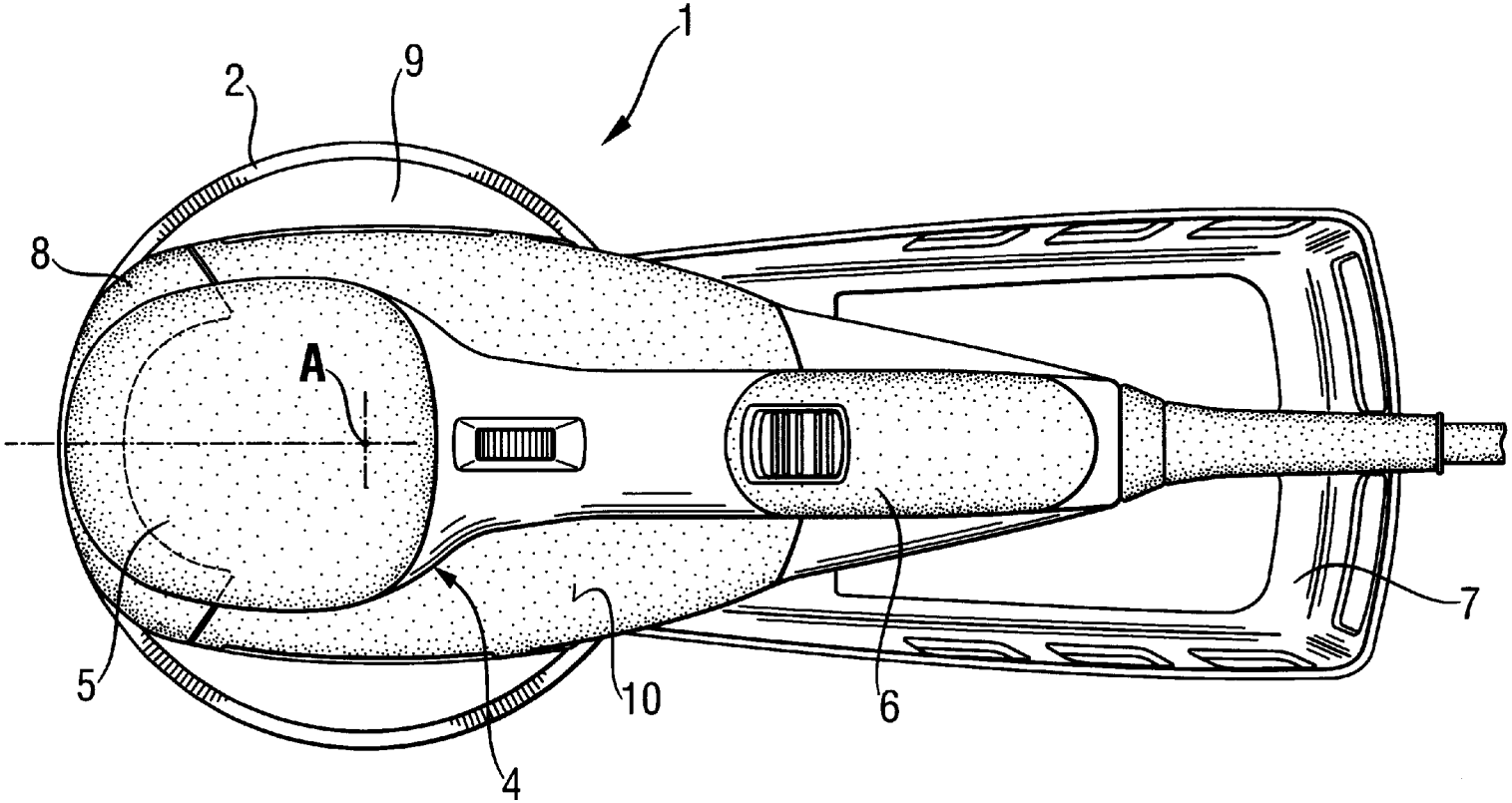
FIG. 2 is a plan view of the grinding device of FIG. 1.

An embodiment of the invention is shown in FIGS. 1 and 2, as a hand-guided grinding device 1. The grinding device 1 has a central housing 4, from which a motor driven grinding disk 2 extends. The grinding disk 2 is mounted on an axis A on a lower side of the central housing 4. The driving motor, usually an electric motor, the transmission and, optionally, other parts, such as a fan wheel for aspirating dust, are accommodated in the central device housing 4. At one side of the central housing 4, a main handle 6 projects laterally and accommodates the electronics of the device and an actuating switch. The energy is supplied to the grinding device over a supply cable, the details of which are not given and which is fastened to the main handle 6 and can be connected, for example, to the a main supply. At the side of the central housing 4 for the device, opposite the main handle 6, an additional handle 8 for a two-handed operation is disposed. At the upper end section of the central housing 4 of the device as viewed in FIG. 1, a bead-like broadening 5 of the housing is provided which, when required, offers a further gripping position for the user.

A housing section 9, axially adjoining the grinding plate 2 directly, has a gripping surface 10 at its upper side below the broadening 5. The housing section 9 protrudes laterally from the central housing 4 of the device at least in certain regions and serves, for example, for accommodating a fan wheel for dust aspiration. The arrangement of the gripping surface 10 is selected so that a one-handed operation is made possible, the tilting moment being kept as small as possible. For this purpose, the gripping surface 10, which extends essentially horizontally, is disposed at an average distance of about 100 mm to about 140 mm from a grinding surface 3, defined by the planar contacting surface of the grinding disk 2. In relation to the central axis A, extending through the center of the grinding disk 2, the central housing 4 is disposed offset in the direction of the additional handle 8 along a line connecting the main handle 6 and the additional handle 8. At least ⅗ of the additional gripping surface 10 extends essentially from the central housing 4 of the device in the direction of the main handle 6. In this connection, a section of the gripping surface 10 embraces a peripheral region of the central housing of the device amounting to about 240° to about 320°. For ergonomic reasons, the gripping surface 10 is constructed so that it slopes downward slightly in the direction of the main handle 6. The projection of the additional gripping surface 10 and the grinding surface 3 essentially overlap one another. Moreover, the bulk of the projection of the additional gripping surface 10 lies within the grinding surface 3, so that it is possible to work close to the edge.

The main handle 6 is bent in hoop fashion and, with one arm, adjoins the housing section 9, having the additional gripping surface 10. A dust collection device 7 extends below this arm of the main handle 6 and radially outwardly from the housing section 9. Due to the hoop-like construction of the main handle 6, space for creating the additional gripping surface 10 is afforded. In the opposite lateral direction, the additional gripping surface 10 adjoins the additional handle 8. Preferably, the outer contour of the additional gripping surface 10 changes over essentially continuously into the contour of the additional handle 8. Advantageously, the additional handle 8 is constructed so that it can be pulled out. For this purpose, it is mounted on guiding rails, which have not been labeled or shown and which are disposed in the housing section 9 supporting the additional gripping surface 10. Locking positions on the guiding rails enable the additional handle 8 to be pulled out to different extents, should this be required. So that the additional handle 8 does not interfere with working close to the edge, it does not, in the pushed-in state, protrude over the grinding disk 2. The main handle 6, the further gripping position at the bead-like broadening 5, the additional gripping surface 10 at the section 9 of the device and the additional handle 8 may be coated with a vibration-inhibiting material or manufactured completely from such a material.

What is claimed as new and desired to be protected by letters patent is set forth in the appended claims.

What is claimed is:

1. A hand-guided grinding device comprising a central housing (4) for containing a transmission unit and drive motor, a shaft with an axis (A) extends axially downwardly from said central housing (4) with said central housing offset eccentrically relative to said axis (A), a motor driven grinding disk (2) mounted concentrically on said shaft and having a grinding surface (3) with an outer peripheral edge, a main handle (6) and an additional handle (8) connected to opposite sides of said central housing (4) for the two-handed operation of said grinding device (1), said handles (6, 8) projecting laterally outwardly from opposite sides of said central housing (4), said central housing (4) has a housing section (9) located above and adjoining said grinding disk (2) and located between said grinding disk (2) and said central housing (4) and extending laterally outwardly at least in part on opposite sides of said central housing (4), said housing section (9) having a lower surface adjoining said grinding disk (2) and an upper surface spaced below said main handle along said axis (A) with a gripping surface (10) on said upper surface of said housing section (9) and located at least in part within an axial projection of the outer peripheral edge of said grinding surface (3) and extending continuously around said central housing (4) from one side to an opposite side and below said main handle (6) in the region of the axis (A), with the bulk of an outward extension of said gripping surface (10) located within the axial projection of the outer peripheral edge of said grinding surface, and said gripping surface (10) arranged for an operator of said grinding device to press axially downwardly against said gripping surface affording one-handed gripping operation.

2. A hand-guided grinding device, as set forth in claim 1, wherein the gripping surface (10) extends substantially parallel to the grinding surface (3) and is shaped adjacent said main handle (6) so that it drops off slightly toward the main handle (6), and the average distance of the gripping surface (10) from the grinding surface (3) of the grinding disk (2) is in the range of about 100 mm to about 140 mm.

3. A hand-guided grinding device the sections of the gripping surface (10) extend over about 240° to about 320° of the periphery of the central housing (4) of the device. A hand-guided grinding device comprising a central housing (4) for containing a transmission unit and drive motor, a shaft with an axis (A) extends axially downwardly from said central housing (4), a motor driven grinding disk (2) mounted on said shaft and having a grinding surface (3) with an outer peripheral edge, a main handle (6) and an additional handle (8) connected to opposite sides of said central housing (4) for the two-handed operation of said grinding device (1), said handles (6, 8) projecting laterally outwardly from said central housing (4), said central housing (4) has a housing section (9) located above and adjoining said grinding disk (2) and located between said grinding disk (2) and said central housing (4) and extending laterally outwardly at least in part on opposite sides of said central housing (4), said housing section (9) having a lower surface adjoining said grinding disk (2) and an upper surface spaced below said main handle along said axis (A) with a gripping surface (10) on said upper surface of said housing section (9) and located at least in part within an axial projection of the outer peripheral edge of said grinding surface (3), with the bulk of the outward extension of said gripping surface (10) located within the axial projection of the outer peripheral edge of said grinding surface, and said gripping surface (10) arranged for an operator of said grinding device to press axially against said gripping surface affording one-handed gripping operation sections of the gripping surface (10).

4. A hand-guided grinding device, as set forth in claim 3, wherein the gripping surface (10) adjoins the additional handle (8), with the adjoining outer surfaces thereof changing over continuously into one another.

5. A hand-guided grinding device, as set forth in claim 4, wherein the additional handle (8) can be pulled out in a lateral direction and has at least one locking position in the pulled out direction.

6. A hand-guided grinding device, as set forth in claim 5, wherein the additional handle (8), in the pushed-in state, does not project laterally over the grinding surface (3).

7. A hand-guided grinding device, as set forth in claim 1, wherein the main handle (6) is hoop-shaped and the housing section (9) equipped with the gripping surface (10), adjoins an arm of the hoop-shaped main handle (6) and is connected with the main handle.

8. A hand-guided grinding device, as set forth in claim 1, wherein the gripping surface (10), on said housing section (9) has one of a vibration-inhibiting coating and a vibration-inhibiting material.

9. A hand-guided grinding device, comprising a central housing (4) for containing a transmission unit and drive motor, a shaft with an axis (A) extends axially downwardly from said central housing (4), a motor driven grinding disk (2) mounted on said shaft and having a grinding surface (3) with an outer peripheral edge, a main handle (6) and an additional handle (8) connected to opposite sides of said central housing (4) for the two-handed operation of said grinding device (1), said handles (6, 8) projecting laterally outwardly from said central housing (4), said central housing (4) has a housing section (9) located above and adjoining said grinding disk (2) and located between said grinding disk (2) and said central housing (4) and extending laterally outwardly at least in part on opposite sides of said central housing (4), said housing section (9) having a lower surface adjoining said grinding disk (2) and an upper surface spaced below said main handle along said axis (A) with a gripping surface (10) on said upper surface of said housing section (9) and located at least in part within an axial projection of the outer peripheral edge of said grinding surface (3), with the bulk of the outward extension of said gripping surface (10) located within the axial projection of the outer peripheral edge of said grinding surface, and said gripping surface (10) arranged for an operator of said grinding device to press axially against said gripping surface affording one-handed gripping operation at least ⅗ of the gripping surface (10) extends from the central housing (4) in the direction of said main handle (6).

* * * * *